US006249659B1

(12) United States Patent
Stickler

(10) Patent No.: US 6,249,659 B1
(45) Date of Patent: Jun. 19, 2001

(54) TONER CARTRIDGE WITH CONDUCTIVE DRIVE HUB

(75) Inventor: Tom E Stickler, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/505,550

(22) Filed: Feb. 17, 2000

(51) Int. Cl.[7] ..... G03G 15/16

(52) U.S. Cl. ..... 399/90; 399/286; 399/119; 492/15; 492/42

(58) Field of Search ..... 399/119, 90, 265, 399/270, 271, 285, 286; 492/15, 60, 42

(56) References Cited

U.S. PATENT DOCUMENTS 5,283,619 2/1994 Nomura et al. .
5,305,062 * 4/1994 Sato et al. ..... 355/245
5,634,175 * 5/1997 Michlin et al. ..... 399/90
5,648,838 * 7/1997 Michlin et al. ..... 399/119
5,768,658 * 6/1998 Watanabe et al. ..... 399/111
5,815,782 * 9/1998 Yokomori et al. ..... 399/285
6,064,841 * 5/2000 Matsuzaki ..... 399/90

* cited by examiner

*Primary Examiner*—Richard Moses
(74) *Attorney, Agent, or Firm*—John A. Brady

(57) ABSTRACT

A toner cartridge for an electrostatic printer or copier includes an electrophotographic drum, a toner container, a fixed electrode for receiving a developing bias voltage, and a developer roller for supplying the toner to an electrostatic latent image on the electrophotographic drum. A drive hub is press fit into an end of the developer roller. The drive hub has a unitary nonconducting plastic body, with a plug portion for elastically and slidably press-contacting the end of the developer roller, an elongated axle portion with an uninterrupted bearing surface, a shoulder portion for supporting a spring, and a longitudinal passage running through the axle and shoulder portions. A wire is disposed in the passage and makes an electrical connection with the spring and the developer roller.

36 Claims, 4 Drawing Sheets

TONER CARTRIDGE WITH CONDUCTIVE DRIVE HUB

FIELD OF THE INVENTION

This invention relates to a toner cartridge for an electrophotographic printer or copier, and more particularly, to a toner cartridge with a plastic drive hub having a conductive interconnection for a developer roller mounted in the cartridge.

BACKGROUND OF THE INVENTION

An electrophotographic printing device such as a printer or copier prints an image on media such as sheets of paper or labels from toner contained in a toner cartridge. A developer roller or sleeve is mounted within the toner cartridge in proximity to a photoconductive drum. The photoconductive drum is charged, and a laser scans the charged photoconductive drum with a laser beam to discharge the surface and form a latent image thereon. The developer roller magnetically attracts statically charged toner from the toner container. An AC bias voltage is applied to the developer roller to insure uniform distribution of the toner, while a DC bias voltage is applied to establish print density. Toner is transferred from the developer roller to the photoconductive drum to develop the latent image formed on the photoconductive drum. The developed image is then transferred to statically charged media, such as paper. Heat then fixes the visible image on the media.

A pair of hubs positioned at the ends of the developer roller rotatably mount the roller within the toner cartridge. At least one of the hubs is electrically conductive, and provides an electrical connection for the bias voltage applied to the developer roller.

The hubs are usually made of aluminum metal. The aluminum in the hubs provides an electrical connection for the bias voltage and a rigid support for the rotating developer roller. The aluminum hubs are assembled into the toner cartridge by press fitting into the ends of the developer roller.

However, the use of aluminum hubs in a toner cartridge has significant disadvantages. The press fitting of the hubs into the ends of the developer roller requires accuracy, and is difficult to perform without deforming the developer sleeve. The hubs are then not concentrically mounted with the developer roller, resulting in uneven development during the image transfer process, and consequently, low quality images. Aluminum is not a durable bearing material, and wear shortens the life of the toner cartridge. Aluminum hubs are also expensive, thus increasing the cost of a toner cartridge.

SUMMARY OF THE INVENTION

A toner cartridge in accord with the present invention overcomes the foregoing problems by using hubs made of an inexpensive nonconductive durable plastic material. One of the hubs is made conductive by having a wire disposed in an axially aligned passage to provide an electrical connection for the developer roller. The toner cartridge includes an electrophotographic drum, a toner container, a fixed electrode for receiving a developing bias voltage, and a developer roller. The hubs are press fit into the ends of the developer roller. The conductive hub has a unitary nonconducting plastic body, with a plug portion for elastically and slidably press-contacting the end of the developer roller, an elongated axle portion with an uninterrupted outer bearing surface, a shoulder portion for supporting a coil spring, and a longitudinal passage running through the axle and shoulder portions. The wire is disposed in the passage and makes an electrical connection between the coil spring and the developer roller.

An object of this invention is to provide a toner cartridge for a printer or copier that is long lasting.

Another object of this invention is to provide a toner cartridge for a printer or copier that is inexpensive to manufacture.

An even further object of this invention is to provide a toner cartridge for a printer or copier that produces high quality images.

A further object of this invention is to provide a toner cartridge for a printer or copier that is easy to assemble.

A still further object of this invention is to provide a toner cartridge for a printer or copier that has enhanced bearing life.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
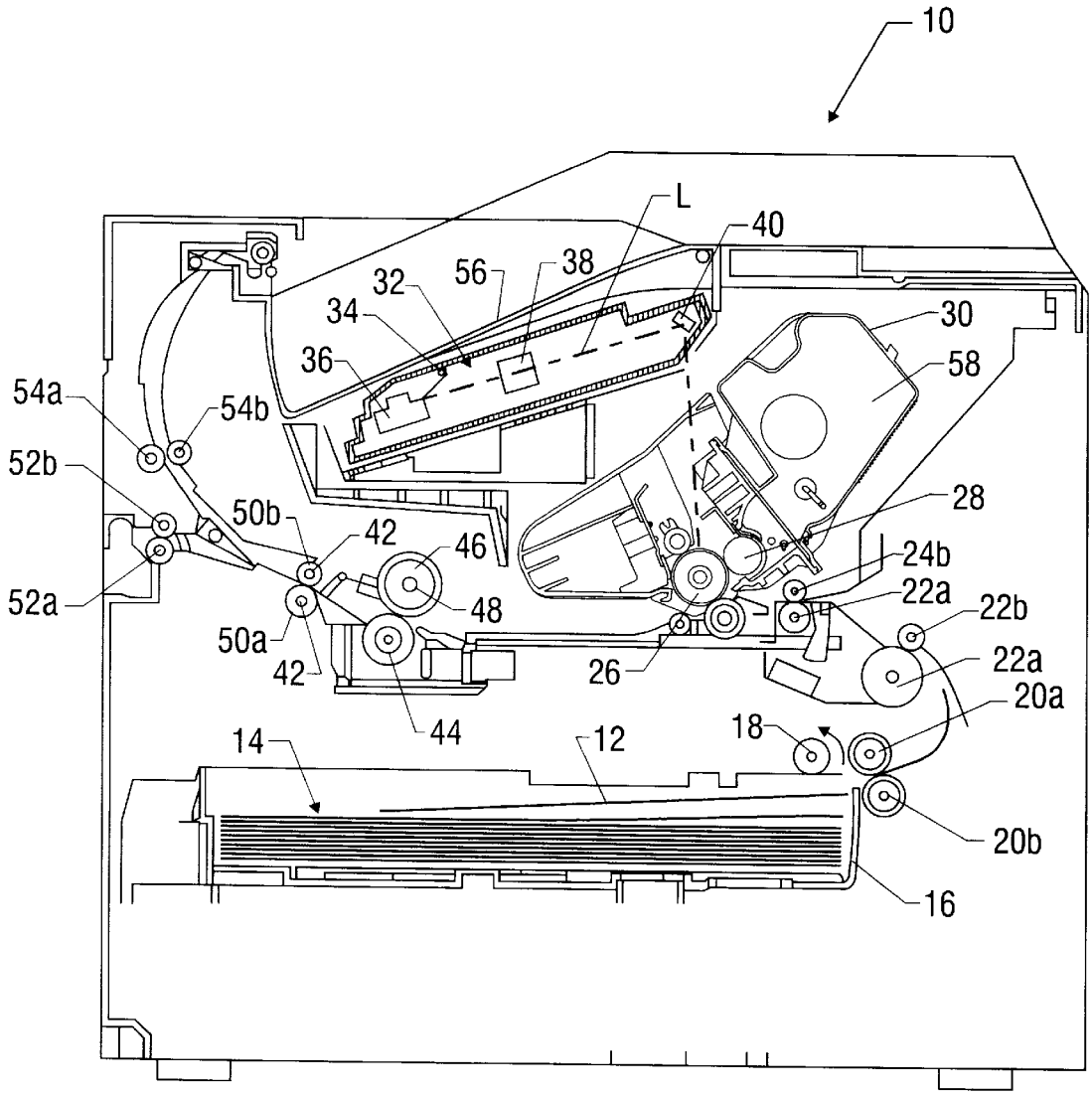
FIG. 1 is a cutaway side view of an electrophotographic printer with a toner cartridge of the present invention disposed therein.

Referring to the drawings, and initially to FIG. 1 thereof, there is shown an electrophotographic printing device such as a printer 10 for printing images on media 12 such as sheets of paper, labels, or fabric, contained in a stack 14 in a cassette 16. The sheets of media 12 are picked up from the cassette 16 by a pickup roller 18 and fed by two pairs of conveyer rollers 20*a*, 20*b*, 22*a*, 22*b* and a pair of register rollers 24*a*, 24*b* past a photosensitive drum 26 mounted in a toner or process cartridge 30. An optical system 32 of the printer 10 includes a laser diode 34, a polygonal mirror 36, a lens 38, and a full reflection mirror 40. The laser diode 34 emits a laser beam L to scan a latent image onto the photosensitive drum 26. A developer sleeve or developer roller 28 transfers toner to the latent image on the photosensitive drum 26. The sheets of media 12 receive toner transferred from the developer roller 28 to the latent image formed on the photosensitive drum 26. The visible image on the media 12 is fixed to form a permanent image at a fixing station 42. The fixing station 42 includes a driving roller 44, a heating roller 46, and a fixing roller 48. Three pairs of discharge rollers 50*a*, 50*b*, 52*a*, 52*b*, 54*a*, 54*b* transfer the sheets of media 12 to a discharge or output tray 56 after the images on the sheets of media 12 have been fixed at the fixing station 42. It is to be appreciated that the toner cartridge 30 includes a toner container portion 58 for containing the toner transferred from the developer roller 28 to the photosensitive drum 26, and then to the sheets of media 12. Once the toner in the toner container portion 58 of the toner cartridge 30 has been exhausted, the toner cartridge 30 must be replaced.

Turning now to FIGS. 2 through 11, the developer roller 28 is rotatably mounted in the toner cartridge 30 by a conductive drive hub 100 and an idler hub 102. The hubs 100, 102 have a unitary, nonconducting plastic body with a longitudinally disposed bore 104. The hubs 100, 102 are slidably press fit into corresponding open ends 106, 108 of the developer roller 28. A developing bias voltage from a voltage source 110, including a DC bias voltage for establishing print density and an AC bias voltage for insuring uniform distribution of the toner, is applied to the developer roller 28 through a stationary contact 112, a coil spring 114, and an interconnecting wire 116.

Figure 2:
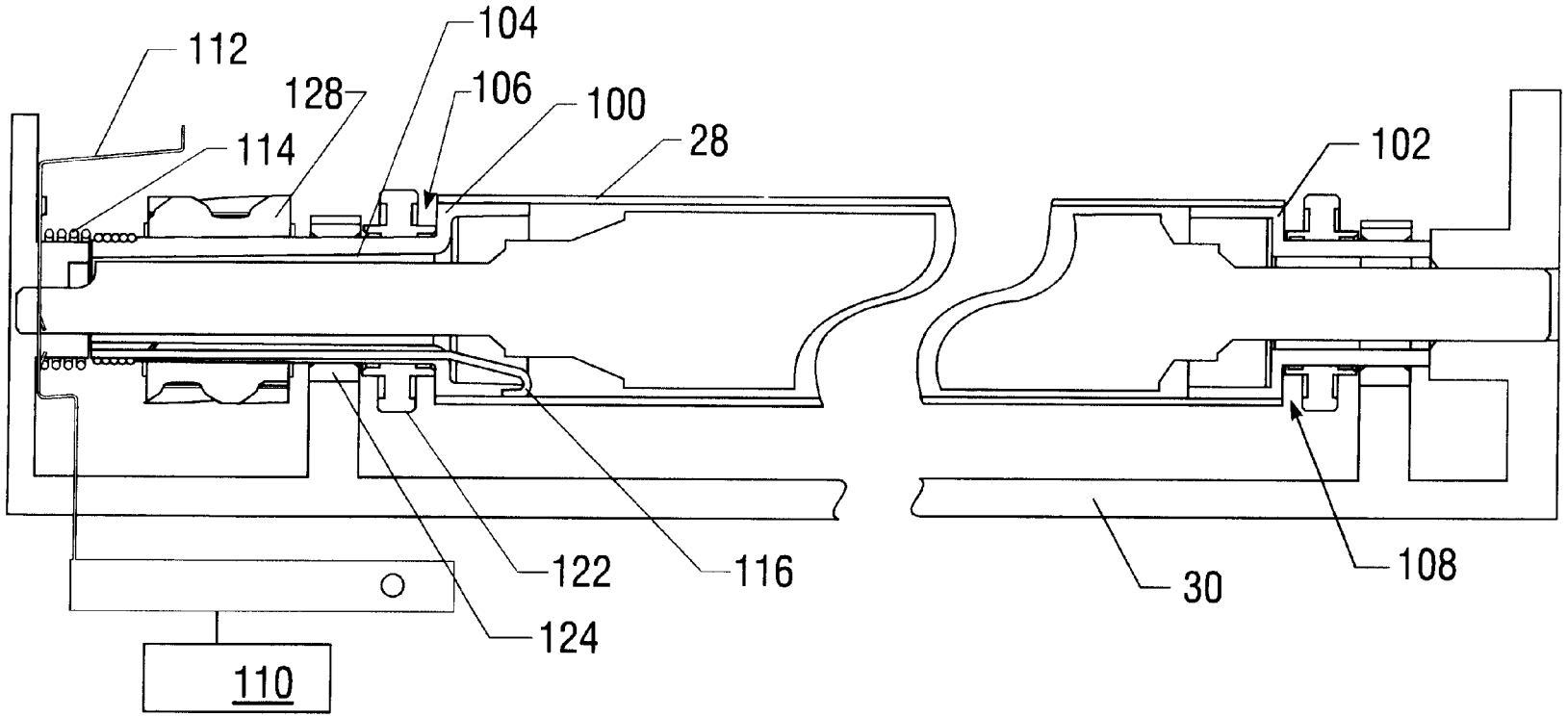
FIG. 2 is a partially cutaway side view of a developer roller in the toner cartridge of FIG. 1.

It is to be appreciated from FIG. 2 that the idler hub 102 lacks the coil spring 114 and the interconnecting wire 116, and accordingly, does not supply voltage to the developer roller 28.

The hubs 100, 102 are made of a nonconductive polycarbonate plastic with a low coefficient of friction fluoropolymer additive such as TEFLON® fluoropolymer. One such plastic is sold by Mitsubishi under the designation LS2030. However, other suitable plastics will be suggested to those of skill in the art. The hub 100 has an enlarged proximal end or plug portion 118 dimensioned to be press fit into the end 106 of the developer roller 28 and to be fixedly secured thereby.

An elongated axle portion 120 extends from the plug portion 118 and receives a spacer 122 and a support bearing 124 on a rounded land 126. The land 126 is positioned on the exterior surface of the hub 100, is substantially uniformly circular in cross-section with an uninterrupted bearing surface, and forms a smooth fit with the spacer 122 and the support bearing 124. The spacer 122 precisely positions the developer roller 28 in proximity to the photosensitive drum 26 while the support bearing 124 bears the weight of the developer roller 28. A drive gear 128 engages a pair of corresponding flats or flat portions 130*a*, 130*b* located on diametrically opposed sides of the exterior surface of the axle portion 120. The drive gear 128, when driven by a mating gear (not shown) attached to the photosensitive drum 26, rotates the hub 100 and the attached developer roller 28 as part of the image transfer process of the printer 10.

A transition area or zone 132 connects the axle portion 120 with a shoulder 134 located at the distal end of the hub 100. The coil spring 114 is press fit onto the shoulder 134 for a secure connection with the hub 100. The coil spring 114 engages the stationary contact 112 and provides an electrical connection to the voltage source 110 (see FIG. 2).

Figure 5:
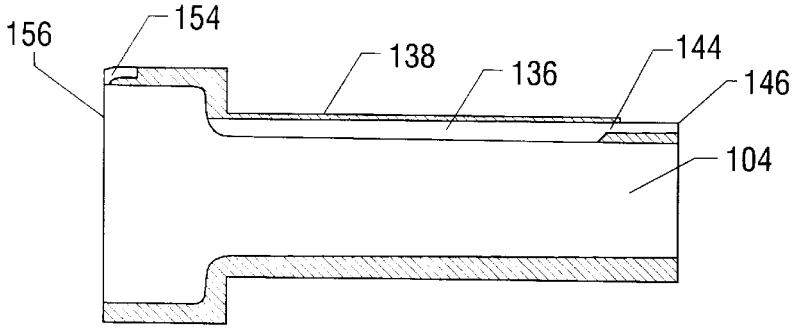
FIG. 5 is a partial side cutaway view of the hub of FIG. 3 showing a passage formed therein.
Figure 6:
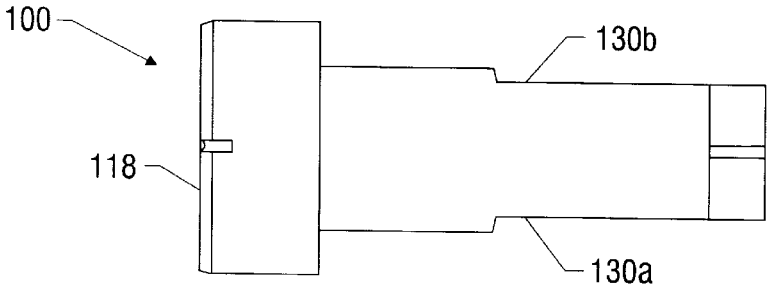
FIG. 6 is a top plan view of the hub of FIG. 3.
Figure 9:
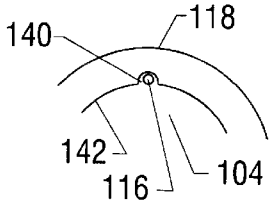
FIG. 9 is a cross-sectional view taken along the lines 9—9 of FIG. 4.
Figure 10:
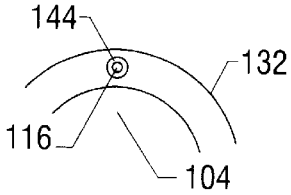
FIG. 10 is a cross-sectional view taken along the lines 10—10 of FIG. 4.
Figure 11:
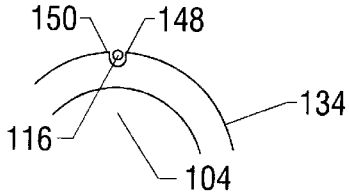
FIG. 11 is a cross-sectional view taken along the lines 11—11 of FIG. 4.

An axially aligned longitudinal passage 136 is formed along the lateral edge of the hub 100, contains the interconnecting wire 116, and provides a continuous passageway through the axle portion 120, the transition area 132, and the shoulder 134. With reference to FIGS. 5 and 9, the passage 136 is a substantially U-shaped portion 138 disposed in the axle portion 120 of the hub 100. The U-shaped portion 138 has an open face or portion 140 located on an interior surface 142 of the longitudinally disposed bore 104 of the hub 100. With reference to FIGS. 5 and 10, the passage 136 is a bore 144 through the transition area 132 of the hub 100, i.e., the bore 144 is completely contained within the thickness of the hub 100. With reference to FIGS. 5 and 11, the passage 136 is a U-shaped portion 146 disposed in the shoulder 134 of the hub 100. The U-shaped portion 146 has an open face or portion 148 located on an exterior surface 150 of the hub 100.

It will be appreciated from the foregoing Figures that the interconnecting wire 116 contacts the coil spring 114 in the U-shaped portion 146 of the shoulder 134, and hence provides an electrical connection with the stationary contact 112.

Figure 3:
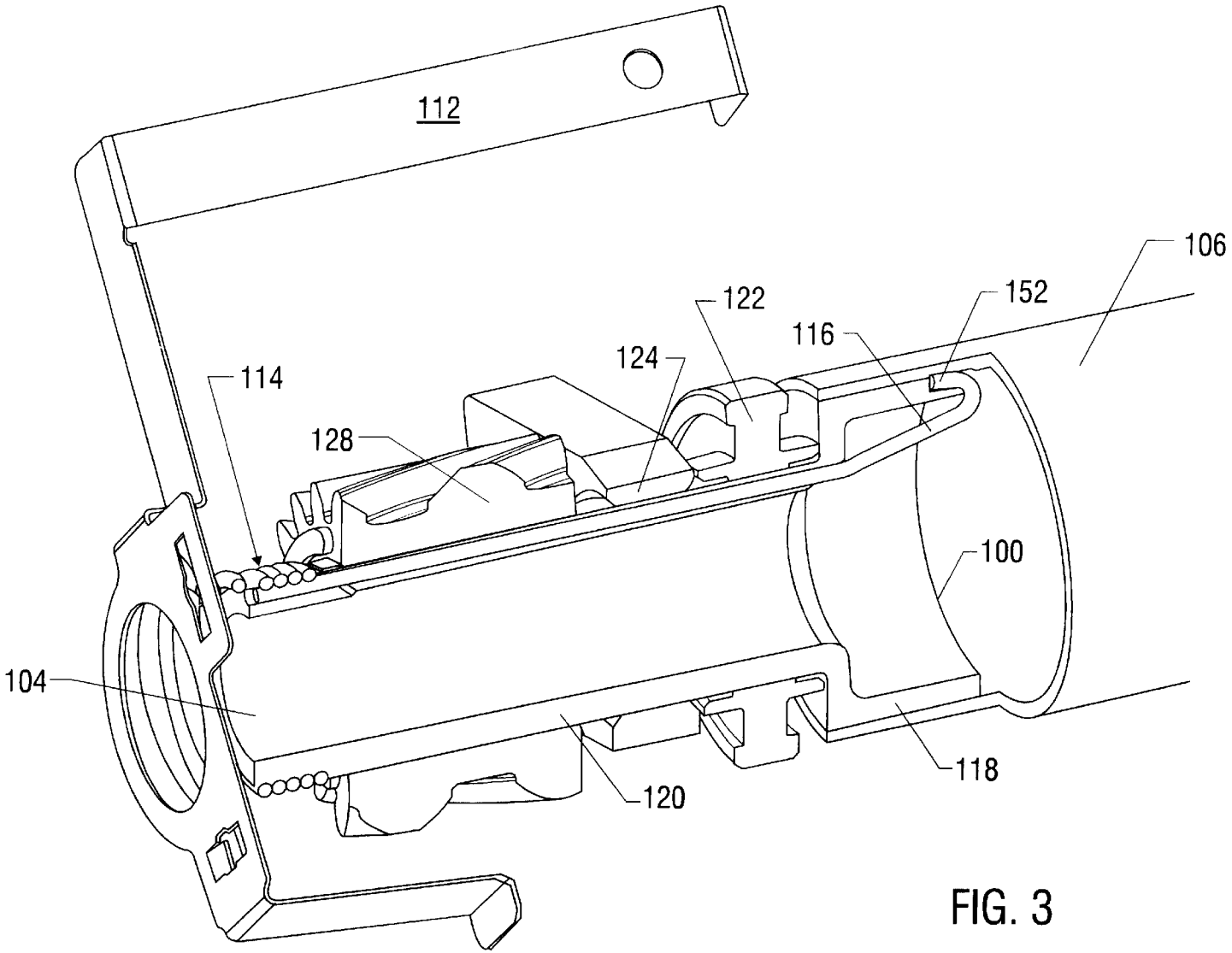
FIG. 3 is a perspective view of a conductive hub in the toner cartridge of FIG. 1.
Figure 4:
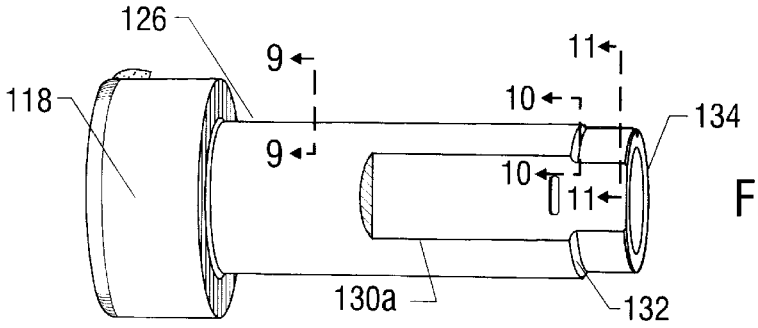
FIG. 4 is a side view of the hub of FIG. 3.
Figure 7:
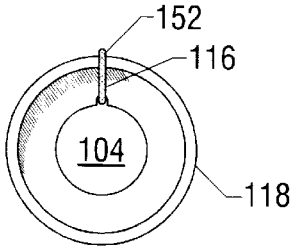
FIG. 7 is a plan view of the proximal end of the hub of FIG. 3.
Figure 8:
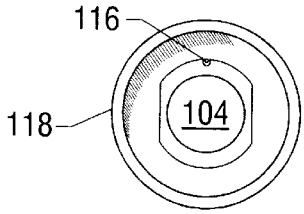
FIG. 8 is a plan view of the distal end of the hub of FIG. 3.

With reference to FIGS. 3, 5 and 7, the interconnecting wire 116 includes a bent portion 152 positioned in a groove 154 formed in the plug portion 118 of the hub 100 and wrapping around the outer edge 156 of the plug portion 118. When the plug portion 118 is press fit into the end 106, the bent portion 152 of the interconnecting wire 116 is elastically deflected when pressed into contact with the inside surface of end 106, thus making a reliable electrical connection between the voltage source 110, the stationary contact 112, the coil spring 114, and the developer roller 28.

Since the hubs 100, 102 are made of a nonconductive plastic material with some elasticity, the hubs 100, 102 do not deform the developer roller by being press fit into the ends 106, 108. Accordingly, the hubs 100, 102 are self-centering, and remain concentric with the developer roller 28 after assembly. The hubs 100, 102 thus precisely position the developer roller 28 to the photosensitive drum 26, resulting in accurate transfer of toner to develop the latent image. The superior wear characteristics of the lubricated plastic hub material reduces unnecessary wear on the spacer 122 and the support bearing 124, contributing to a long life for the toner cartridge 30.

An additional advantage of the present invention is that a printer 10 using the toner cartridge 30 produces high quality images, as the spacing between the developer roller 28 and the photosensitive drum 26 remains constant over the length of the developer roller 28 due to the superior mounting and wear characteristics of the hubs 100, 102.

The assembly process for the toner cartridge 30 is relatively error-free, resulting in a high yield of useable toner cartridges 30, as it is not difficult accurately to press fit the hubs 100, 102 into the ends 106, 108 without damaging the developer roller 28.

The hubs 100, 102 exhibit improved bearing wear when engaging the support bearing 124 because of the inherently slick properties of the plastic material with its low coefficient of friction fluoropolymer additive. This feature additionally contributes to a long life for the toner cartridge 30. The hubs 100, 102 reduce the cost of the toner cartridge 30, as the plastic material used in the hubs 100, 102 is inexpensive.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. A toner cartridge for an electrostatic image forming apparatus, comprising:

an image bearing member for forming an electrostatic latent image;

a toner container for holding a supply of toner;

a fixed electrode for receiving a developing bias voltage;

a rotatable and electrically conductive sleeve for supplying said toner to said electrostatic latent image formed on said image bearing member, said sleeve having an end thereof; and a conductive drive hub fixedly supported in said end of said sleeve, said drive hub having a unitary nonconducting plastic body, said body having a plug portion for elastically and slidably press-contacting said end, an elongated axle portion, a shoulder portion for supporting a spring, a longitudinal passage running through said elongated axle portion and said shoulder portion, and a wire disposed in said passage for making an electrical connection by contact with coils of said spring and with said sleeve.

2. The toner cartridge of claim 1, wherein said shoulder portion has an outer surface, and wherein said passage in said shoulder portion is U-shaped in cross-section and is open in said outer surface.

3. The toner cartridge of claim 2, wherein said plastic body has a longitudinally disposed bore therethrough and said axle portion has an inner surface forming a portion of said bore, and wherein said passage in said axle portion is U-shaped in cross-section and is open in said inner surface.

4. The toner cartridge of claim 3, wherein said body has a transition portion disposed between said axle portion and said shoulder portion.

5. The toner cartridge of claim 4, and further comprising a cylindrical bore disposed in said transition portion of said body and communicating between said passage in said shoulder portion and said passage in said axle portion.

6. The toner cartridge of claim 5, wherein said plug portion has a passage formed therein, and wherein said wire has a bent portion disposed in said passage for making an electrical connection with said sleeve.

7. The toner cartridge of claim 6, and further comprising a drive gear, and wherein said axle portion has a pair of flat portions diametrically opposed to each other for engaging said drive gear.

8. The toner cartridge of claim 7, and further comprising a bearing, and wherein said elongated axle portion includes an uninterrupted smooth portion for rotatably supporting said bearing.

9. The toner cartridge of claim 8, and further comprising a spacer, and wherein said elongated axle portion includes an uninterrupted smooth portion for rotatably supporting said spacer.

10. In a toner cartridge for an electrostatic image forming apparatus having an image bearing member for forming an electrostatic latent image, a toner container for holding a supply of toner, a fixed electrode for receiving a developing bias voltage, a rotatable and electrically conductive sleeve for supplying said toner to said electrostatic latent image formed on said image bearing member, said sleeve having an end thereof, the improvement comprising a conductive drive hub fixedly supported in said end of said sleeve, said drive hub having a unitary nonconducting plastic body, said body having a plug portion for elastically and slidably press-contacting said end, an elongated axle portion, a shoulder portion for supporting a spring, a longitudinal passage running through said elongated axle portion and said shoulder portion, and a wire disposed in said passage for making an electrical connection by contact with coils of said spring and with said sleeve.

11. The improvement of claim 10, wherein said shoulder portion has an outer surface, and wherein said passage in said shoulder portion is U-shaped in cross-section and is open in said outer surface.

12. The improvement of claim 11, wherein said plastic body has a longitudinally disposed bore therethrough and said axle portion has an inner surface forming a portion of said bore, and wherein said passage in said axle portion is U-shaped in cross-section and is open in said inner surface.

13. The improvement of claim 12, wherein said body has a transition portion disposed between said axle portion and said shoulder portion.

14. The improvement of claim 13, and further comprising a cylindrical bore disposed in said transition portion of said body and communicating between said passage in said shoulder portion and said passage in said axle portion.

15. The improvement of claim 14, wherein said plug portion has a passage formed therein, and wherein said wire has a bent portion disposed in said passage for making an electrical connection with said sleeve.

16. The improvement of claim 15, wherein said toner cartridge includes a drive gear, and wherein said axle portion has a pair of flat portions diametrically opposed to each other for engaging said drive gear.

17. The improvement of claim 16, wherein said toner cartridge includes a bearing, and wherein said elongated axle portion includes an uninterrupted smooth portion for rotatably supporting said bearing.

18. The improvement of claim 17, wherein said toner cartridge includes a spacer, and wherein said elongated axle portion includes an uninterrupted smooth portion for rotatably supporting said spacer.

19. A conductive drive hub for a roller comprising:

a unitary nonconducting plastic body, said body having a plug portion for attaching to said roller, an elongated axle portion, a shoulder portion for supporting a spring, and a longitudinal passage running through said elongated axle portion and said shoulder portion; and a wire disposed in said passage and making an electrical connection with said spring by contact with coils of said spring.

20. The conductive hub of claim 19, wherein said shoulder portion has an outer surface, and wherein said passage in said shoulder portion is U-shaped in cross-section and is open in said outer surface.

21. The conductive hub of claim 20, wherein said plastic body has a longitudinally disposed bore therethrough and said axle portion has an inner surface forming a portion of said bore, and wherein said passage in said axle portion is U-shaped in cross-section and is open in said inner surface.

22. The conductive hub of claim 21, wherein said body has a transition portion disposed between said axle portion and said shoulder portion.

23. The conductive hub of claim 22, and further comprising a cylindrical bore disposed in said transition portion of said body and communicating between said passage in said shoulder portion and said passage in said axle portion.

24. The conductive hub of claim 23, wherein said plug portion has a passage formed therein, and wherein said wire has a bent portion disposed in said passage for making an electrical connection with said roller.

25. The conductive hub of claim 24, and further comprising a pair of flat portions diametrically opposed to each other and formed on said outer surface of said axle portion for engaging a drive gear.

26. The conductive hub of claim 25, wherein said elongated axle portion includes an uninterrupted smooth portion for rotatably supporting a bearing.

27. The conductive hub of claim 26, wherein said elongated axle portion includes an uninterrupted smooth portion for rotatably supporting a spacer.

28. A conductive drive hub for a developer roller in an electrostatic image forming apparatus comprising:

a spring for making an electrical connection with a stationary contact;

a unitary nonconducting plastic body, said body having a plug portion for elastically and slidably press-contacting into an end of said developer roller, an elongated axle portion, a shoulder portion for supporting said spring, and a longitudinal passage running through said elongated axle portion and said shoulder portion; and a wire disposed in said passage and making an electrical connection with said spring by contact with coils of said spring.

29. The conductive hub of claim 28, wherein said shoulder portion has an outer surface, and wherein said passage in said shoulder portion is U-shaped in cross-section and is open in said outer surface.

30. The conductive hub of claim 29, wherein said plastic body has a longitudinally disposed bore therethrough and said axle portion has an inner surface forming a portion of said bore, and wherein said passage in said axle portion is U-shaped in cross-section and is open in said inner surface.

31. The conductive hub of claim 30, wherein said body has a transition portion disposed between said axle portion and said shoulder portion.

32. The conductive hub of claim 31, and further comprising a cylindrical bore disposed in said transition portion of said body and communicating between said passage in said shoulder portion and said passage in said axle portion.

33. The conductive hub of claim 32, wherein said plug portion has a passage formed therein, and wherein said wire has a bent portion disposed in said passage for making an electrical connection with said developer roller.

34. The conductive hub of claim 33, wherein said electrostatic image forming apparatus includes a drive gear, and wherein said axle portion includes a pair of flat portions diametrically opposed to each other for engaging said drive gear.

35. The conductive hub of claim 34, wherein said electrostatic image forming apparatus includes a bearing, and wherein said elongated axle portion includes an uninterrupted smooth portion for rotatably supporting said bearing.

36. The conductive hub of claim 35, wherein said electrostatic image forming apparatus includes a spacer, and wherein said elongated axle portion includes an uninterrupted smooth portion for rotatably supporting said spacer.

* * * * *